United States Patent [19]

Stockli et al.

[11] 4,333,192

[45] Jun. 8, 1982

[54] METHOD OF MAKING BOOTS FOR AQUATIC ACTIVITIES

[76] Inventors: André Stockli, 2086 Prieur St.; Fernando Castaneda, 7838 Casgrain St., both of Montreal; Jean-Louis Stockli, 3112 Gérard St., Fabreville, all of Canada

[21] Appl. No.: 101,213

[22] Filed: Dec. 7, 1979

Related U.S. Application Data

[62] Division of Ser. No. 922,070, Jul. 5, 1978, abandoned.

[51] Int. Cl.[3] ..... A43D 9/00; A43D 13/08

[52] U.S. Cl. ..... 12/142 E; 12/142 RS; 36/14

[58] Field of Search ..... 12/142 RS, 142 T, 142 E, 12/142 EV; 36/14

[56] References Cited

U.S. PATENT DOCUMENTS

| | | | |
|---|---|---|---|
| 1,622,860 | 3/1927 | Cutler | 36/14 |
| 2,437,030 | 3/1948 | Hoza . | |
| 2,578,218 | 12/1951 | Ashworth | 36/14 |

*Primary Examiner*—Patrick D. Lawson

[57] ABSTRACT

This invention relates to a method of making boots for aquatic activities, more particularly for underwater diving. The method consists in the steps of forming a sock from a sheet of cellular elastomeric material and adhering an outsole assembly, including unvulcanized non-cellular rubber composition, to the sole portion and to the adjacent part of the upper of the sock all around the sole portion; placing the resulting unit in an oven; and vulcanizing under pressure said outsole assembly in situ on said sock at a maximum temperature below the degrading temperature of the cellular elastomeric material of the sock.

8 Claims, 5 Drawing Figures

METHOD OF MAKING BOOTS FOR AQUATIC ACTIVITIES

This application is a Divisional Application of U.S. Pat. Application Ser. No. 922,070, filed July 5, 1978 now abandoned.

The present invention relates to boots useful in aquatic activities, particularly in underwater diving and also concerns a method of making the same.

Such boots are normally made from a sock rising to just above the ankle, with the sock having an outsole of rubber. The sock itself is normally made by stitching together pieces of cellular elastomer. preferably covered by one of two pieces of fabric, of nylon or similar synthetic yarn. A rubber outsole is then adhered to the bottom of the sock. One known type of outsole is a precut piece which is cemented and stitched to the sock all around the edge of the outsole. In such a known construction, in order for the outsole to be stitched to the sock, it must be made of low grade flexible and soft rubber and the latter, together with the stitching itself, can be easily torn away from the sock during use. Another known type of outsole consists of a molded rubber piece which is cemented to the sock. It has been found that such conventional divers' boots do not last very long.

It is an object of the invention to provide a method of a boot which obviates the above-noted disadvantages in that the rubber outsole is directly molded and vulcanized in situ and adheres to the sock without any stitching.

The present invention resides in a method of making a boot, which method comprises the steps of forming a sock including a sole portion and an upper, from a sheet of cellular elastomeric material; adhering an outsole assembly including unvulcanized non-cellular rubber composition to said sole portion and to the adjacent part of the upper all around the sole portion; placing the resulting unit in an oven and vulcanizing under pressure said outsole assembly in situ on said sock at a maximum temperature below the degrading temperature of the cellular elastomeric material of the sock.

Preferably, said elastomeric material is cellular neoprene, and the rubber composition of the outsole assembly is natural rubber.

A preferred embodiment of the present invention will be hereinafter described with reference to the accompanying drawings, wherein.

In the drawings, like reference characters indicate like elements throughout.

Figure 1:
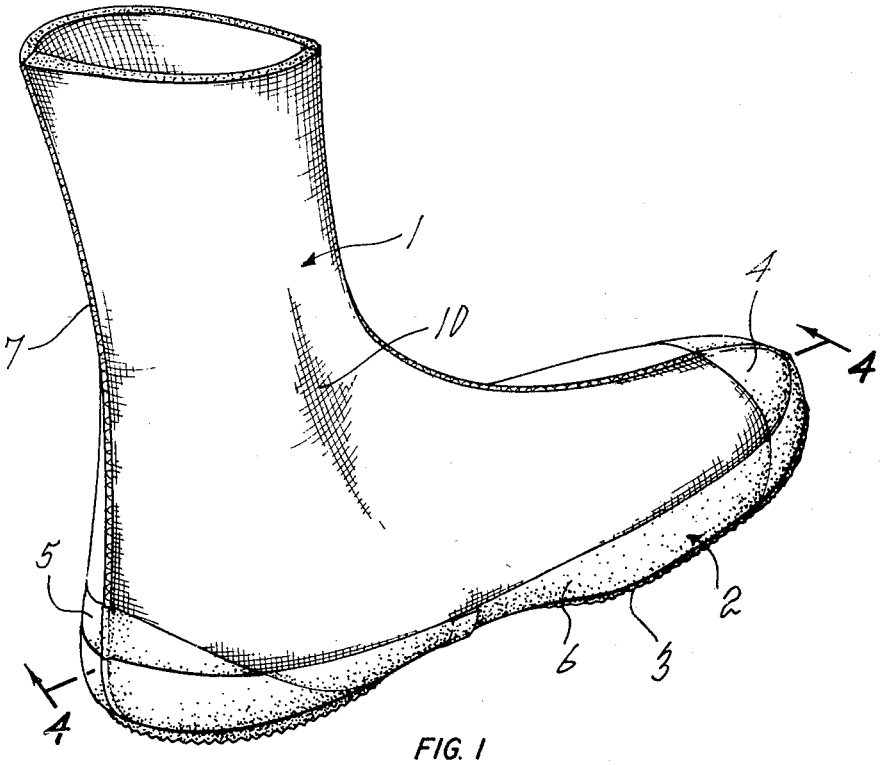
FIG. 1 is a perspective view of a boot in accordance with the invention.
Figure 2:
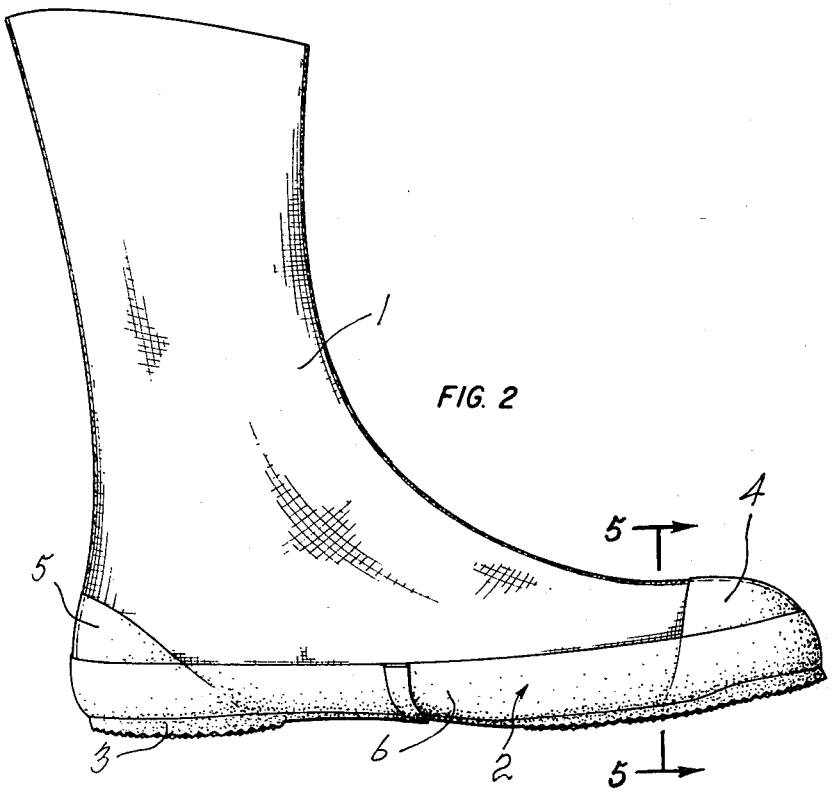
FIG. 2 is a side elevation of the same.
Figure 3:
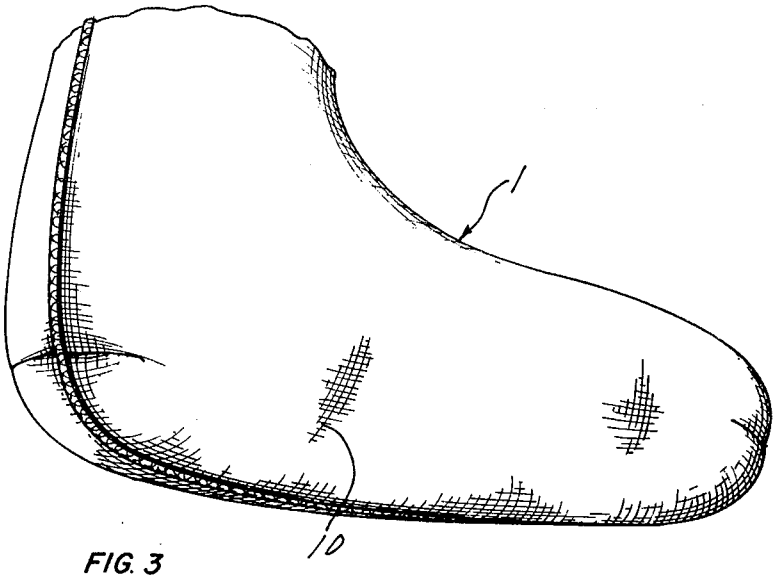
FIG. 3 is a perspective view of the sock proper, the upper portion being cut away.
Figure 4:
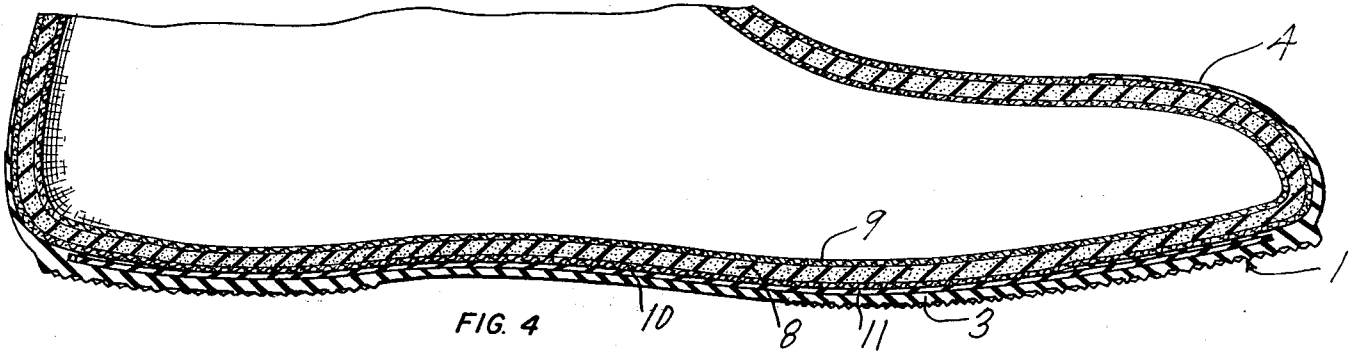
FIG. 4 is a longitudinal section of the boot, taken along line 4—4 of FIG. 1.
Figure 5:
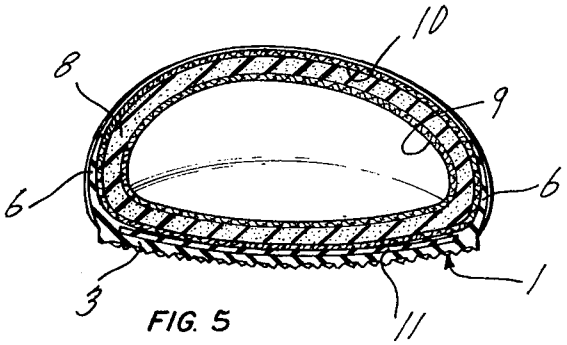
FIG. 5 is a cross-section, taken along line 5—5 of FIG. 2.

As illustrated in the drawings, the boot comprises a sock 1, covered in part by an outsole assembly; generally indicated at 2, and made of rubber. The outsole assembly more specifically includes an outsole proper, indicated at 3, a toe-cap 4 covering the toe portion of the sock 1, a back stay 5 covering the heel portion of the sock 1 and a foxing 6 surrounding the entire lower edge of the sock 1 and forming an integral unit with the outsole 3, the toe-cap 4 and the back 5.

The sock 1 is made from at least one piece of flexible and heat-insulating material, properly cut and stitched to form the sock. In the example shown, two pieces are used; they are stitched together by the line of stitching 7 extending in the central vertical plane of the sock. Thus, the insulating material is made of a layer 8 of cellular synthetic elastomer, such as cellular neoprene. Layer 8 may be used as is, or one or both faces of which can be covered by a fabric of synthetic yarn, such as nylon, adhering to layer 8. The drawings show an inside fabric 9 and an outside fabric 10. As an example, thickness of the sock may vary from 5 to 7 millimeters and it has a high thermal insulation property, is highly flexible and absorbs water, a maximum of about five percent by weight of the material.

This sock is made in a conventional manner in the making of the boot. Once the sock has been prepared, a metal last is inserted therein to impart to the sock the shape of a boot with a sole surface. The underside and the lower edges of the sock are then covered with a first cost of a neoprene base cement which adheres to cellular neoprene layer 8 by being absorbed through the fabric 10 and which also adheres to the outside fabric 10, the latter being generally made of nylon. Then, a second coat of cement, namely a natural rubber base cement, is applied on the first cost. The second coat ahderes to the first coat and also to the outsole assembly 2, since the latter is made of natural rubber. The various rubber parts are then applied to the cement-coated sock. First, a filler 11 is applied and adhered to the sole surface; filler 11 consists of a fabric impregnated with natural unvulcanized rubber and of about 45 thousandths of an inch thick; unvulcanized natural rubber parts including the toe-cap 4, the back stay 5 and the foxing 6 are then applied and adhered to the sock 1 and to the filler fabric 11 in their proper position. The outsole 3 is then applied and adhered to the sock, and the entire assembly is then placed in an autoclave subjected to heat and pressure to vulcanize the outsole assembly 2 in situ. The vulcanization, or curing cycle, is such that the natural rubber components are progressively brought to a temperature of a maximum of 240° F. during one hour and then cured for another three hours at 240° F., such temperature being chosen so as not to degrade the elastomeric property of the sock material. The autoclave is then opened and the resulting boot has its proper shape and has its outsole assembly vulcanized in situ and firmly adhering to the sock. No stitching whatever is needed to attach the outsole assembly to the sock. Since no stitching is required, high grade natural rubber parts are selected to make the outsole assembly.

It is to be noted that it is important not to exceed the degrading temperature of the sock material in the vulcanization step. In this respect, a vulcanizing cycle of $1\frac{3}{4}$ hour at 30 pound-pressure with a curing cycle of first one-half hour with a temperature rising up to 270° F. and with a further $1\frac{1}{4}$ hour with a temperature remaining at 270° F., has been tried. However, in that experiment, it was noted that the temperature and vulcanizing cycle used caused a great reduction in the thickness of the foam of the sock, which would have resulted in a great loss in the heat-insulating property of the material of the sock.

In the vulcanizing cycle used, it is to be noted that a lower temperature than 240° F. could be used; but then with a longer curing cycle. In fact, room temperature could be used for vulcanization; but the curing cycle would last one week, which is not practical.

The pressure used during vulcanization is normally 30 pounds, but could be as low as 10 pounds per square inch.

What we claim is:

1. A method of making a boot for divers and the like, comprising the steps of forming a sock from a sheet of cellular elastomeric material, said sock including a sole portion and an upper, said elastomeric material covered at least on the outside of said sock by a fabric of synthetic yarn adhering to said elastomeric material over the entire surface of the latter, adhering an outsole assembly including an unvulcanized, non-cellular rubber composition, to said sole portion and to the adjacent part of the upper all around the sole portion, placing the resulting unit in an oven and vulcanizing under pressure said outsole assembly in situ on said sock at a maximum temperature below the degrading temperature of the cellular elastomeric material of the sock.

2. A method as claimed in claim 1, wherein said maximum vulcanizing temperature is a maximum of about 240° F.

3. A method as claimed in claim 1, wherein said vulcanizing is carried out by progressively increasing the temperature from room temperature to said maximum vulcanizing temperature, and then maintaining said maximum vulcanizing temperature till vulcanization is completed.

4. A method as claimed in claim 2 or 3, wherein the pressure is between 10 and 30 pounds per square inch.

5. A method as claimed in claim 1, wherein said elastomeric material is cellular neoprene and the rubber of said outsole assembly is natural rubber, and further including applying a first coat of neoprene base cement to said sole portion and to the adjacent part of the upper all around said sole portion, and applying a second coat of natural rubber base cement over said first coat, said outsole assembly of unvulcanized rubber being adhered to said sock by means of said first and second coats.

6. A method as claimed in claim 1, wherein said synthetic yarn is nylon yarn.

7. A method as claimed in claim 1 or 5, wherein said unvulcanized outsole assembly is adhered to said sock by separately adhering an outsole to said sole portion, a back stay to the heel of the sock, a toe-cap to the toe portion of the sock and a foxing to the lower edge of the sock all around the outsole, said back stay, toe-cap and foxing forming an integral assembly with said outsole once the vulcanizing step has been carried out.

8. A method of making a boot for divers and the like, comprising the steps of forming a sock from a sheet of cellular neoprene material, said sock including a sole portion and an upper, applying a first coat of neoprene base cement to said sole portion and to the adjacent part of the upper all around said sole portion, applying a second coat of natural rubber base cement over said first coat, adhering an outsole assembly made of unvulcanized non-cellular natural rubber to said sole portion and to the adjacent part of the upper all around the sole portion by means of said first and second coats, placing the resulting unit in an oven and vulcanizing under pressure said outsole assembly in situ on said sock at a maximum temperature below the degrading temperature of the cellular neoprene material of the sock.

* * * * *